United States Patent [19]

Hosono et al.

[11] Patent Number: 4,766,468

[45] Date of Patent: Aug. 23, 1988

[54] DEVELOPING METHOD AND APPARATUS FOR A PHOTOCOPIER

[75] Inventors: Nagao Hosono, Hachiohji; Haruo Fujii; Yujiro Ando, both of Yokohama; Kimio Nakahata, Kawasaki, all of Japan

[73] Assignee: Canon Kabushiki Kaisha, Tokyo, Japan

[21] Appl. No.: 15,570

[22] Filed: Feb. 13, 1987

Related U.S. Application Data

[63] Continuation of Ser. No. 619,113, Jun. 11, 1984, abandoned.

[30] Foreign Application Priority Data

Jun. 15, 1983 [JP] Japan ..... 58-108078

[51] Int. Cl.[4] ..... G03G 15/09

[52] U.S. Cl. ..... 355/3 DD; 118/648; 118/657; 430/103; 430/120

[58] Field of Search ..... 355/3 R, 3 DD, 14 D; 346/153.1, 157; 118/645, 648, 651, 657, 658; 430/103, 120, 122

[56] References Cited

U.S. PATENT DOCUMENTS

| | | | |
|---|---|---|---|
| 3,570,453 | 3/1971 | Nuzum | 118/637 |
| 3,850,662 | 11/1974 | Jahn | 355/3 R X |
| 4,164,372 | 8/1979 | Gundlach et al. | 355/3 DD |
| 4,194,830 | 3/1980 | Ohnuma et al. | 355/3 DD |
| 4,382,420 | 5/1983 | Ohnuma et al. | 355/3 DD X |
| 4,395,112 | 7/1983 | Miyakawa et al. | 355/3 DD X |
| 4,446,471 | 5/1984 | Yano | 355/3 TR X |
| 4,502,061 | 2/1985 | Ando et al. | 355/3 DD X |
| 4,511,239 | 4/1985 | Kanbe et al. | 355/3 DD |

FOREIGN PATENT DOCUMENTS 49-130844 11/1974 Japan .

*Primary Examiner*—Fred L. Braun

*Attorney, Agent, or Firm*—Fitzpatrick, Cella, Harper & Scinto

[57] ABSTRACT

A method of development includes providing a mixture of non-magnetic developer particles and magnetic particles in a developer supply container, carrying the mixture on an insulating surface of an endlessly movable developer carrying member and confining the magnetic particles within the developer supply container by cooperation of a magnetic pole of a fixed magnetic field generator and a magnetic particle confining member. The method also includes providing an electrode opposed to, and extending in a longitudinal direction of, the carrying member, applying a developer application signal between the electrode and the developer carrying member to apply the developer particles only to such an area as corresponds to application of the developer application signal, and developing a latent image on a latent image bearing member with the thus applied developer particles.

21 Claims, 7 Drawing Sheets

DEVELOPING METHOD AND APPARATUS FOR A PHOTOCOPIER

This application is a continuation of application Ser. No. 619,113 filed June 11, 1984, now abandoned.

BACKGROUND OF THE INVENTION

The present invention relates to a developing method and apparatus for developing only a desired area with a dry developer, more particularly to, a developing method and apparatus for developing a desired area of an electrostatic latent image bearing member by applying a dry developer only to a desired area of a developer carrying member at a desired time. Further, the present invention relates to a developing method and apparatus for multi-color developing the latent image on the image bearing member in accordance with the above developing and method.

Heretofore, it has been very difficult to develop, with a dry developer, only a desired part of a latent image on an image bearing member. For example, it is thought that a developer coating area of a two component developer layer on a developing roller is controlled by a mechanical shutter or the like, but the control area is different from that desired, because the two component developer layer formed in the conventional two component developer apparatus is thick. When the two component developer layer thus defined is contacted to a latent image bearing member, the development area further expands unclearly, so that it has been almost impossible to develop only a desired area of a latent image area.

Some proposals have been made as to a method of obtaining a multi-color recording by only one transferring step in an electrophotographic apparatus. However, those are all directed to a two color recording method wherein a positive latent image and a negative latent image are formed on an image bearing member, so that the latent image formation is not stable. In addition, it is required to use a reverse development. Therefore, those methods are not practical. Furthermore, there is another problem that the recording is not possible for more than two colors.

SUMMARY OF THE INVENTION

It is a principal object of the present invention to provide a developing method and apparatus wherein the developable area or section can be controlled as desired.

It is another object of the present invention to provide a method and apparatus for development, wherein a developer thin layer forming method for a one component developer is used, and wherein the one component developer of the dry type is coated on a developer carrying member at a desired area and time only, and the thus formed limited area of the developer coating is used for the development, whereby only a desired area can be developed.

It is a further object of the present invention to provide a developing method and apparatus wherein different areas of one electrostatic latent image is sequentially developed with different color developers, whereby multi-color recording is provided by a single image transfer step.

According to one aspect of the present invention, there is provided a method of development, comprising the steps of providing a mixture of non-magnetic developer particles and magnetic particles in a developer supply container, carrying the mixture on an insulating surface of an endlessly movable developer carrying member, confining the magnetic particles within the developer supply container by cooperation of a magnetic pole of a fixed magnetic field generating means and a magnetic particle confining member, providing an electrode opposed to, and extending in a longitudinal direction of, the carrying member, applying a developer application signal between the electrode and the developer carrying member to apply the developer particles only to such an area or section as corresponds to the application of the developer application signal, and developing a latent image on a latent image bearing member with the thus developer particles, so that only a desired area or section of the latent image formed on a latent image bearing member can be developed.

According to another aspect of the present invention, there is provided a method of development, comprising the steps of providing a developing device including a developer supply container for containing a mixture of non-magnetic developer particles and magnetic particles; and endlessly movable developer carrying member having an insulating surface for carrying the developer particles; means, provided in said developer carrying member, for generating a fixed magnetic field; a member cooperable with said fixed magnetic field generating means to confine the magnetic particles within said developer supply container; an electrode opposed to said carrying member and extending in a longitudinal direction thereof; and voltage applying means for applying a developer application signal to apply the developer to the carrying member at a desired area or section, supplying developer particles of different colors into the respective developer containers, and developing different areas or sections of the latent image bearing member by the respective developing devices for the different colors, so that different areas of a latent image can be developed with different color developer, thus providing a multi-color developed image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preffered embodiment of the present invention will be described in detail in conjunction with the accompanying drawings.

Figure 1:
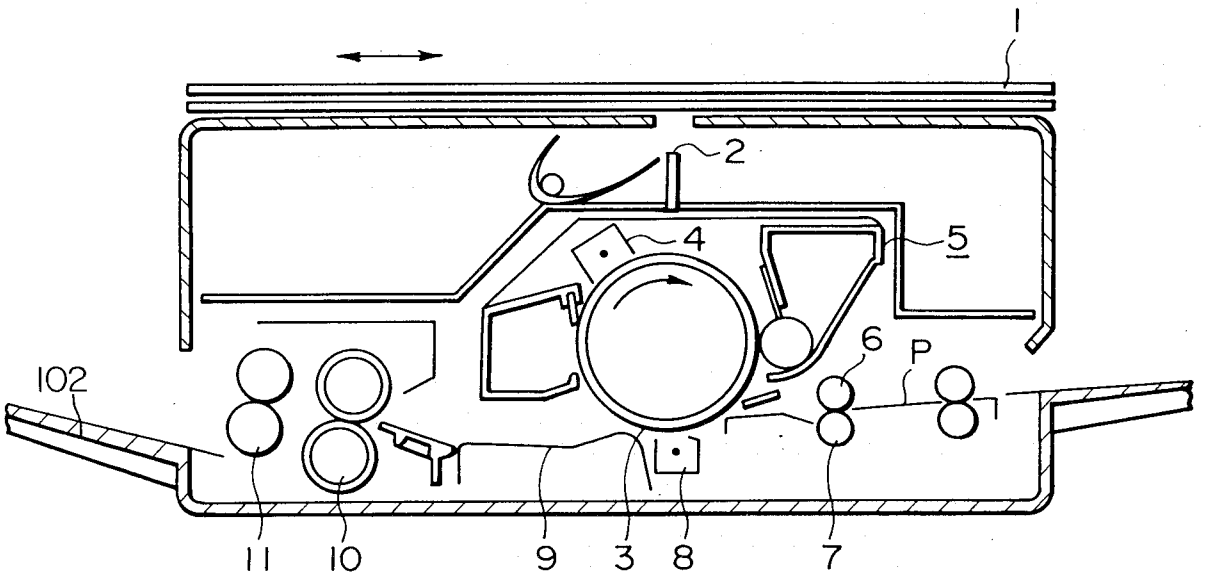
FIG. 1 shows an electrophotographic copying apparatus to which the development method and apparatus according to the present invention is applicable.

FIG. 1 is a cross-sectional view of an electrophotographic copying apparatus incorporating a method and apparatus for development according to an embodiment of the present invention. The copying apparatus comprises a horizontally reciprocable original carriage having a transparent member, an array 2 of short focus lenses having a small diameter, and a photosensitive member 3 on which an image of the original placed on the original carriage 1 is projected through a slit by the lens array 2. The photosensitive member 3 is shown as a drum, but it may be an endlessly movable web. The photosensitive member 3 is uniformly charged by a charger 4, and then exposed to the image light through the lens array 1 so that an electrostatic latent image is formed thereon. The thus formed electrostatic latent image is visualized by the developing apparatus 5 according to the present invention. On the other hand, a transfer material P is fed by a feed roller 6 and a registration roller 7 which feeds the transfer meterial P in timed relation with the image formed on the photosensitive member 3. The visualized image (toner image) on the photosensitive member 3 is then transferred onto the transfer material P by a transfer discharger 8. The transfer material P is separated from the photosensitive member 3, and then conveyed along a guide 9 to an image fixing device, whereat the toner image is fixed on the transfer material P. Finally the transfer material is discharged to a tray 102 by a discharging rollers.

Figure 2:
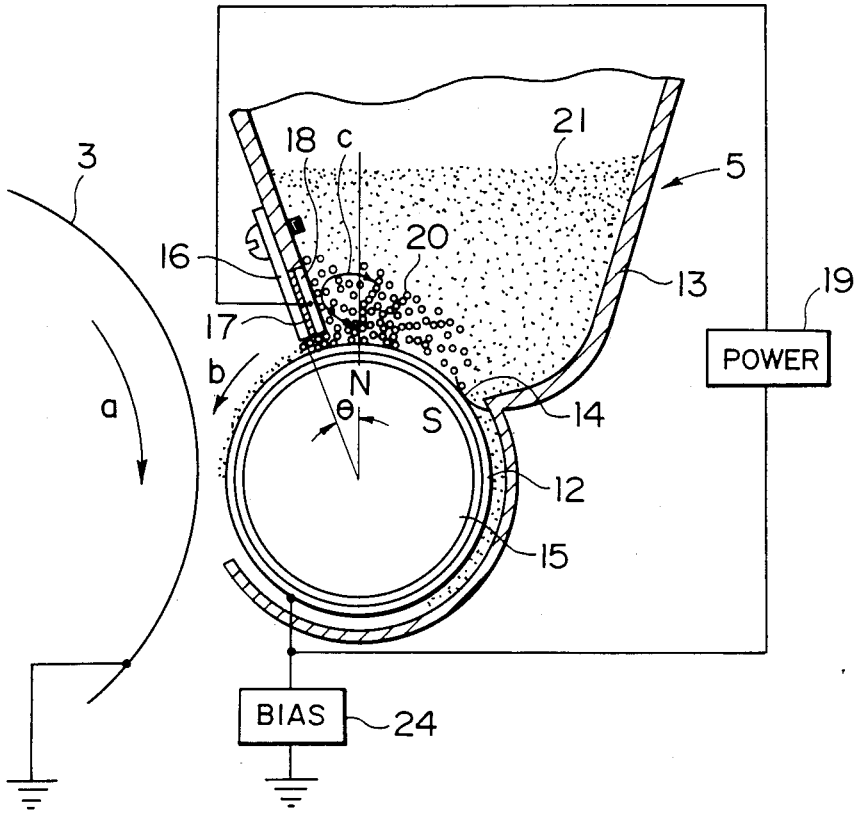
FIG. 2 is a cross-sectional view of a developing apparatus according to an embodiment of the present invention.

FIG. 2 illustrates the method and apparatus according to an embodiment of the present invention, wherein the photosensitive member 3 rotates in the direction of arrow a. Opposed to the surface of the photosensitive member 3 with a gap, there is provided a non-magnetic member 12 for carrying a developer. The carrying member 12 has an insulating surface layer which is sufficient to retain electric charge thereon. The carrying member 12 also has a conductive backing layer. In this embodiment, the developer carrying member 12 is in the form of a cylinder, or more particularly, a sleeve, but it may be an endlessly movable web, as with photosensitive member 3. With the rotation of the photosensitive member 3, the carrying member 12 is rotated in the direction of arrow b. A developer supply container 13 is provided to supply the developer to the carrying member 12. The container 13 is provided with an opening adjacent its lower part. The carrying member 12 is provided in the opening. Since the carrying member 12 is partly exposed outside, the surface thereof moves from the inside of the container 13 to the outside thereof and then back into the container 13. The container 13 has the bottom portion which encloses the carrying member 12 to prevent the developer from leaking out. To ensure the prevention of leakage, a sealing member 14 is provided. Inside the carrying member 12, magnetic field generating means, i.e., a magnet 15 in this embodiment, is fixedly supported so that the carrying member 12 only rotates. The magnet 15 has magnetic poles N and S, as shown in the Figure. Of these magnetic poles of the magnet 15, the N pole is effective to confine or constrain the magnetic particles within the developer container 13.

In the neighbourhood of the upper part of the container 13, a confining member 16, as magnetic particle confining means, is provided to confine within the container 13 magnetic particles which will be described hereinafter. The confining member 16 is shown as a magnetic blade of a magnetic material in this embodiment. Across the carrying member 12 from the magnetic blade 16 there is a magnetic pole N of the magnet 15. However, the magnetic pole N is not right across, and displaced by a predetermined angle $\theta$ (5–50 degrees) toward upstream with respect to the direction of the movement of the carrying member 12.

To the inside of the magnetic blade 16, an electrode 18 is disposed with an insulating layer 17 therebetween. The electrode 18 extends in the longitudinal direction of the carrying member 12. A voltage can be applied between the electrode 18 and the conductive layer of the carrying member.

Into the container 13 of the above-descrived structure, magnetic particles or a mixture of magnetic particles and non-magnetic developer particles are supplied so that a base layer 20 is formed. The mixture constituting the base layer 20 preferably contains 5–70 wt. % of non-magnetic developer, but may only have magnetic particles. The particle diameter of the magnetic particle is 30–200, preferably 70–150, microns. Each of the magnetic particle may consist of a magnetic material or may consist of a magnetic material and non-magnetic material. The magnetic particle in the base layer 20 is formed into a magnetic brush by the magnetic field provided by the magnet 15, which brush is effective to perform a circulation which will be described in detail hereinafter. A magnetic brush is also formed between the magnetic pole N and the magnetic particle confining member 16, which is effective to constrain the magnetic particles of the base layer 20 within the container 13.

Above the base layer 20, non-magnetic developer particles are supplied to form a developer layer 17, so that two layers are formed generally horizontally in the container 13, that is, one layer on the outer surface of the carrying member 12 and the other layer on the one layer. The non-magnetic developer supplied may contain a small amount of magnetic particles, but even in that case, the magnetic particle content of the developer layer 21 is smaller than that of the base layer 20. To the non-magnetic developer particles, silica particle for enhancing the flowability and/or abrasive particles for effectively abrading the surface of the photosensitive member 3 may be added.

The formation of the two layers is not limited to this manner, i.e., two materials are supplied separately, but may be made, for example, by supplying a uniform mixture of the magnetic particles and non-magnetic developer containing the sufficient amount of respective materials for the entire base layer 20 and developer layer 21, and then strongly vibrating the container 13 to form the two layers, using the magnetic field of the magnet 15 and the difference in the specific gravity between the two materials.

It is practicable that the two layers are not specifically formed, and a substantially uniform mixture of the magnetic particles and non-magnetic developer is simply supplied, if a sufficient amount of magnetic particles are contained to form the magnetic brush. However, for long term and stable formation of the magnetic brush, the positive formation of the two layers is preferable.

After magnetic particles and the non-magnetic developer particles are supplied as described above, carrying member 12 is rotated. The magnetic particles are circulated by the magnetic field provided by the magnetic poles and by gravity, as shown in FIG. 2. More particularly, in the neighbourhood of the surface of the non-magnetic developer carrying member 12 near the bottom of the container 13, the magnetic particles move upwardly along the surface of the carrying member 12 by the cooperation of the magnetic field of the magnet 15 and the rotation of the carrying member 12. The magnetic particles are moved upwardly too by the rotation of the carrying member 12, but are prevented from passing through the clearance between the tip of the magnetic blade 16 and the carrying member 12 by the magnetic field formed between the magnetic blade 16 and magnetic pole N. The magnetic particles behind the magnetic blade 16 within the container 13 are urged by the magnetic particles fed continuously from the bottom of the container 13, and turn, as shown by reference character c in FIG. 2, whereafter they slowly move down under gravity. During this downward movement, the magnetic particles take the non-magnetic developer particles among themselves from the lower part of the developer layer 21. Then, the magnetic particles return to the bottom part of the container 13, and those actions are repeated.

In this embodiment of the present invention, the non-magnetic developer is triboelectrically charged by the contact with the magnetic particles and with the carrying member 12. Preferably, however, the triboelectric charge with the magnetic particles is reduced by treating the surface of the magnetic particle with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic developer is stably coated on the carrying member 12.

In the embodiments described above, the confining member 15 has been explained as of a magnetic material, such as steel. However, a non-magnetic blade may be used which is made of a non-magnetic material such as, aluminum, copper and resin. Also, the wall of the container 13, if it is made of a non-magnetic material, may be used as the confining member. In this case, the clearance between the tip of the non-magnetic blade and the surface of the carrying member 12 is needed to be smaller than the clearance when the magnetic blade is used. Additionally, the peripheral speed of the developer carrying member 12 is required to be not more than 80 mm/sec. The magnetic confining member 15 is preferable in that a stabilized magnetic brush is formed at the developer outlet by the magnetic field between the confining member 15 and the magnetic pole.

At this time, the non-magnetic developer contacts the surface of the developer carrying member 12 so that the non-magnetic developer in the base layer 20 is electrostatically applied on the surface thereof in its slight amount. However, the application of the developer does not have a sufficient thickness to effect a developing function and is not stable. In order to positively apply the developer on an area of the surface of the developer carrying member 12, a developer applying voltage is applied between the carrying member 12 and the electrode 18 by the power source 19 which produces developer application signals consisting of a developer applying voltage and a developer blocking voltage. When the developer applying voltage is applied between the electrode 18 and the developer carrying member 12, an electric field is formed therebetween, which produces an electrostatic force to positively attract the non-magnetic developer onto the carrying member 12.

Figure 3:
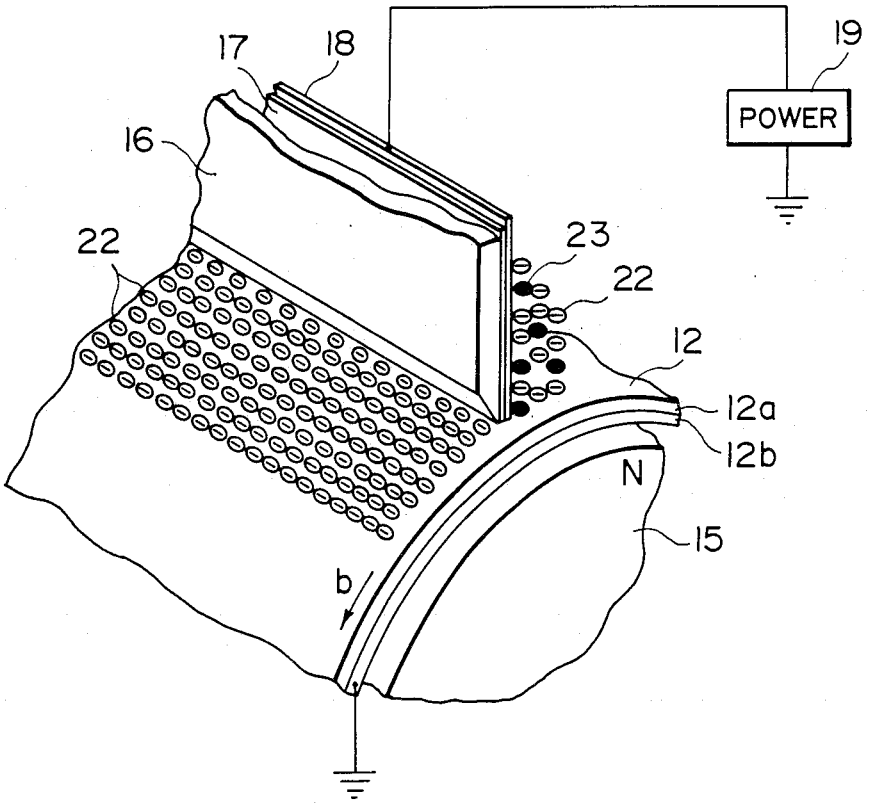
FIG. 3 illustrates an application of a non-magnetic developer on a developer carrying member.

FIG. 3 illustrates the state in which the non-magnetic developer is being applied on the developer carrying member 12. When a negative voltage (the developer applying voltage in this embodiment) is applied to the electrode 18 relative to the carrying member 12 by the power source 19, the non-magnetic developer particles 22 which have been negatively charged by the friction with the magnetic particles or the developer carrying member 12, are attracted to and deposited on the surface of the carrying member 12 by the electrostatic force produced by the electric field formed between the electrode 18 and the carrying member 12. Thus, the non-magnetic developer particles are applied on the carrying member 12, during the carrying member 12 moving in the direction shown by the arrow b. On the other hand, when a positive voltage (the developer blocking voltage in this embodiment) is applied between the electrode 18 and the carrying member 12, the non-magnetic developer particles which have been negatively charged are attracted toward the electrode 18 due to the electric field. Therefore, the non-magnetic developer is not allowed to pass through the clearance between the electrode 18 and the carrying member 12 so that the developer 22 is not applied onto the developer carrying member 12 while the carrying member 12 is moving in the direction shown by the arrow b. Thus, the non-magnetic developer 22 can be selectively applied on the developer carrying member 12 by selectively applying to the electrode 18 the developer applying voltage (negative polarity in this embodiment) or the developer blocking voltage (positive polarity in this embodiment), as shown in FIG. 3.

Since the magnetic pole N of the magnetic 15 is disposed at a fixed position which is upstream of the magnetic blade 16 with respect to the direction of the developer carrying member movement (arrow b), the magnetic particles 23 are constrained or confined by the magnetic field created between the magnetic blade 16 and the magnetic pole N, so that the magnetic particles 23 are not allowed to pass through the clearance between the magnetic blade 16 and the developer carrying member 12.

The developer carrying member 12 is provided with an insulating layer 12*a* to prevent a possible electric leakage which can occur between the electrode 18 and the conductive layer 12*b* of the carrying member 12. Therefore, the electric resistance thereof in the direction of the thickness of the insulating layer is not necessarily high. If the electric resistance is too high, the application of the voltage between the electrode 18 and the carrying member 12 can result in the surface of the insulating layer 12*a* becoming electrically charged through the magnetic particles 23 and the developer particles 22. The charge can increase even to such an extent that the electric field between the electrode 18 and the carrying member 12 surface is extremely weakened so that no electrostatic force is applied to the developer particles 22 even when the developer applying voltage is produced. This makes it difficult to properly control the application of the non-magnetic developer. In view of this, the resistance of the insulating layer 12*a* is preferably $10^7$ ohm.cm/$10^{12}$ ohm.cm.

The developing system to be used here is preferably a non-contact type development disclosed in U.S. Pat. No. 4,395,476, although a conventional contact type development is usable. If the development system of the U.S. patent is used a voltage is applied between the photosensitive member 3 and the carrying member 12 by a bias voltage source 24, as shown in FIG. 2. The bias voltage is of AC, DC or preferably an AC superposed with a DC. The developer to be consumed for the development is supplied from the base layer 20 to the carrying member 12, and the consumption of the developer in the base layer 20 is compensated from the developer layer 21 during the above described circulation.

The developer carrying member 12 may be of an aluminum cylinder coated with fluorine-containing resin or an aluminum cylinder having an alumite-treated surface. Both showed good results. However, the material is not limited to to the foregoing. Thus a resin coated cylinder of stainless steel may also be used.

The clearance between the magnetic blade 16 and the electrode 18 is 80–300 microns, preferably, 100–250 microns. The application voltage to be applied between the electrode 18 and the carrying member 12 is 100–300 V DC voltage. The developer blocking voltage is of the same magnitude but of the opposite polarity.

The apparatus of FIG. 2, which was actually constructed, was operated under the following conditions. The magnet provided 600 gauss of surface magnetic flux density and had an N pole which was 20–30 degrees away from the line connecting the center of the carrying member 12 and the tip of the magnetic blade 16.

As for the magnetic particles, spherical ferrite having 20–80 microns particle size distribution, average particle size, 50 microns, which was coated with insulating material, was used. For the non-magnetic developer, the powder provided by 100 parts of polyester resin incorporated by 3 parts of copper phthalocyanine pigments and 5 parts of negative charge controlling agent (alkylsalicylic acid metal complex) and added by silica 0.6%, was used. It was negatively chargeable and 12 microns ave. diameter. When the developer applying voltage and the developer blocking voltage were selectively applied to the electrode 18, only the area corresponding to the developer applying voltage being applied was coated with the developer, so that only the corresponding area of the image bearing member was developed. The developed image was sharp and clear with a sufficient density.

Figure 4:
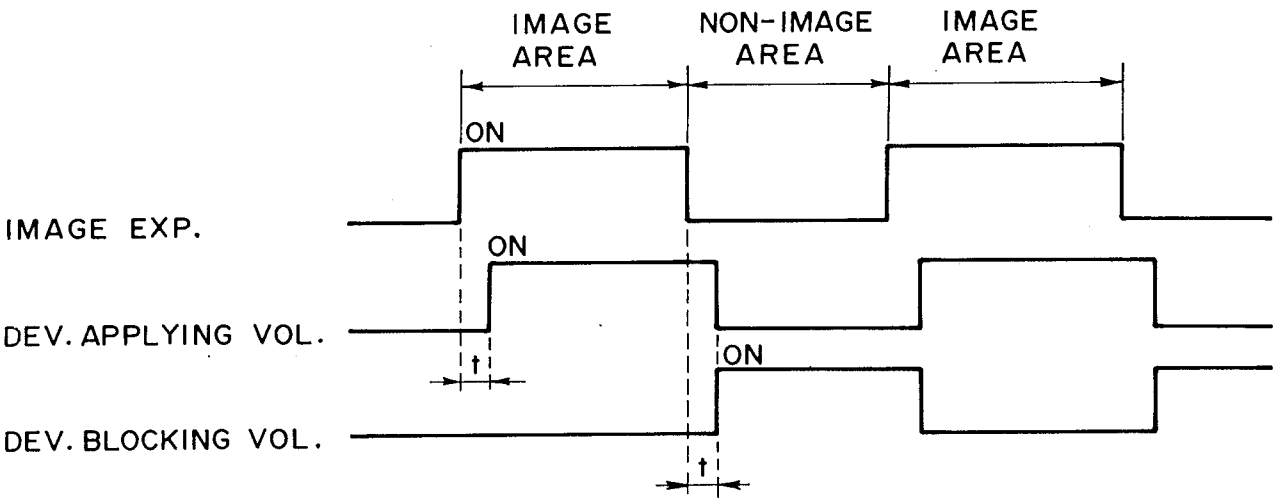
FIG. 4 is a chart showing the timings of applications of a developer applying voltage and a developer blocking voltage.

A developing operation was carried out, using the above described method of the present invention with the timing control of the developer applying voltage and the developer blocking voltage as shown in FIG. 4. When an image exposure is initiated to form a latent image on the image bearing member, the developer applying voltage is applied, with the time delay t, to the electrode 18 shown in FIG. 2 to apply the non-magnetic developer on the developer carrying member 12 at such an area that the developer applied area is aligned with the latent image. When the image exposure completes, the developer blocking voltage is applied, with the same time delay, to the electrode 18 to stop the application of the developer. Thus, a non-image forming area which exists between an image area and the subsequent image area, is not supplied with the developer.

Some methods are known to prevent the developing action from taking place to the non-image area, such as a blank exposure by which light is applied to the non-image area to erase the charge, a method wherein a blade is engaged to the surface of the developer carrying member to prevent the developer application thereonto and a method wherein the rotation of the developer carrying member is stopped to cease the developer application. However, the blank exposure method involves a problem that the boundary between the image area and the non-image area is not clear due to a slow response to the light. Additionally, it involves another problem that the flared light can go into the boundary. The second and the third methods wherein the developer carrying member is engaged by a blade or stopped to prevent the developer application, necessarily increase the variation in the driving torque of the developer carrying member. This results in undesirable vibration of the optical means mounted within the electrophotographic machine.

According to the present invention, the control of the non-image area is quick and free from the above drawbacks, since the application of the non-magnetic developer is positively prevented by applying the developer blocking voltage to the electrode 18 which is opposed to the developer carrying member 12.

Figure 5:
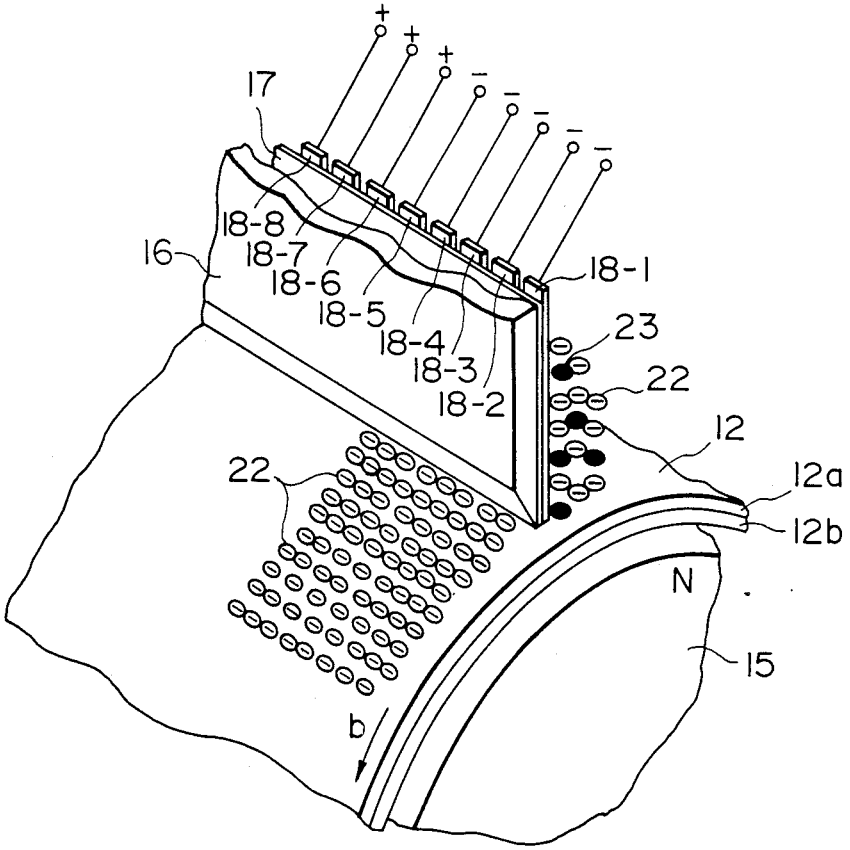
FIG. 5 illustrates a part of the developing apparatus according to another embodiment of the present invention.

FIG. 5 is a perspective view of the apparatus according to another embodiment of the present invention, wherein the electrode 18 is divided into plural electrode members 18-1, 18-2, . . . , 18-n (not shown). To the respective electrode members the voltage can be independently applied from the power source 19. Therefore, the developer applied area can be controlled not only in the direction of the rotation of the developer carrying member 12, but also in the longitudinal direction of the developer carrying member 12. The applied area can be controlled in two dimensions, so that only the desired area of the latent image bearing member can be developed, the area being controlled in two directions. With this embodiment, if used with an electrophotographic copying machine, the developer applied area can be controlled in accordance with the sizes of the transfer material used, whereby the developing action is properly prevented outside the width of the transfer material.

Figure 6:
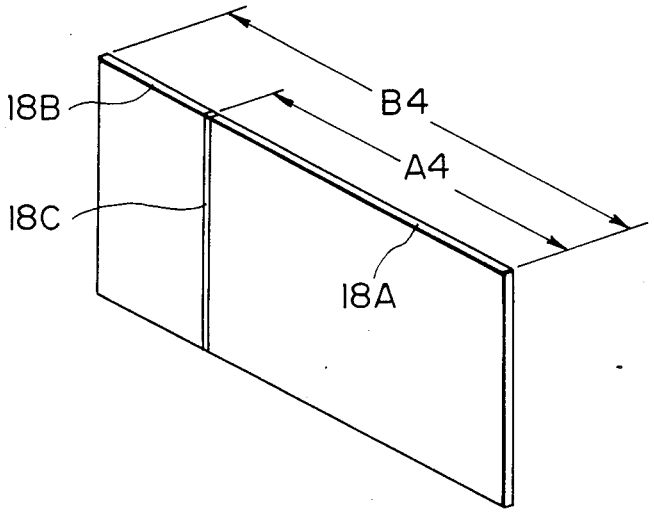
FIG. 6 is a perspective view of an electrode according to another embodiment of the present invention.

FIG. 6 shows an example of the electrode which is suitable for this use with the electrophotographic copying machine, wherein the electrode 18 is divided into two electrode members 18A and 18B, which can be separately supplied with the voltage. Of these electrode members, the electrode member 18A corresponds to the A4 size, and the electrode 18B, when combined with the electrode 18A, corresponds to the B4 size.

Referring back to FIG. 5, the plural electrode members 18-1, 18-2, . . . and 18-n are shown as being provided inside the magnetic blade 10 as the magnetic particle confining member, that is, upstream of the magnetic blade 10 with respect to the movement of the developer carrying member 12. However, in order to prevent the possible leakage between the plural electrode members 18-1 . . . 18-n through the magnetic particles 23 and the developer particles 22, the plural electrode members 18-1 . . . 18-n may be provided outside the magnetic blade 10. As an alternative, the inside surfaces of the plural electrode members 18-1 . . . 18-n may be coated with an insulating layer for leakage prevention and protection.

Figure 7:
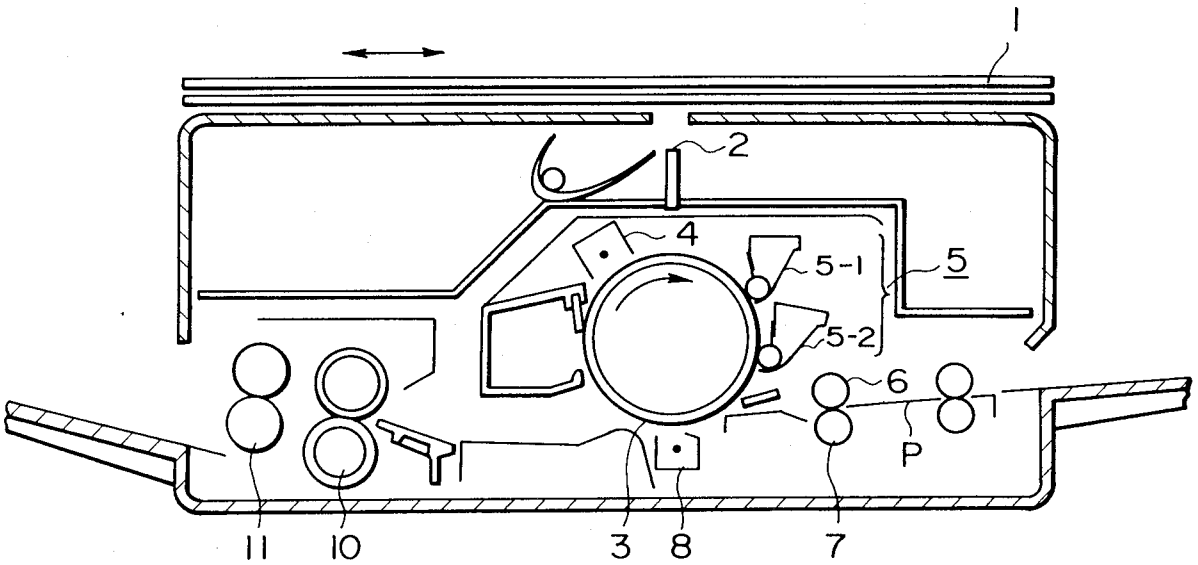
FIG. 7 is a cross-sectional view of an electrophotographic copying apparatus capable of multi-color development using a developing method according to an embodiment of the present invention.

FIG. 7 shows an embodiment using the developing method of the present invention. In the electrophotographic copying apparatus shown in this Figure, there are two developing devices 5-1 and 5-2, which are constructed to perform the developing method according to the present invention. Those two developing devices 5-1 and 5-2 effect a multi-color development operation. The developing devices 5-1 and 5-2 contain red developer particles (toner) and blue developer particles, respectively. By the selective supply of the voltage from the power source 19, the red and blue developer particles are applied to different areas of the carrying member 12 at different timings. Then, a latent image on the photosensitive drum 3 is developed with those applied developer particles. The red developer and blue developer develop different areas of the single latent image on the latent image bearing member, that is, the photosensitive drum 3. This was actually performed, and two color recording was provided from a single latent image by a single image transfer operation. By increasing the number of the developing devices, a multi-color recording can be provided from a single latent image, in an increased number of colors.

As described above, according to the present invention, a layer of developer particles of uniform and sufficient thickness for the use of the developing operation can be formed only in the area of the developer carrying member surface that is desired. When such a controlled area of the developer layer is opposed or approached to the surface of the latent image bearing member which is rotating with a latent image thereon, only the area of the latent image which corresponds to the developer layer having the limited area can be developed.

By using two or more developing devices having different color developers which are constructed to perform the developing method of the present invention, it is made possible to first develop a part of the image area and then develop another part thereof by a different developing device and to repeat this. Thus, a multi-color developing operation which can provide a multi-color recording by a single image transfer operation is acomplished.

While the invention has been described with reference to the structures disclosed herein, it is not confined to the details set forth and this application is intended to cover such modifications or changes as may come within the purposes of the improvements or the scope of the following claims.

What is claimed is:

1. A method of developing a latent image formed on a latent image bearing member by latent image forming means, comprising the steps of:

providing a developer carrying member, movable along an endless path, for carrying a non-magnetic developer for deposit on the latent image bearing member;

disposing a magnetic member adjacent to a surface of the developer carrying member so as to allow the non-magnetic developer to be fed from a developer container containing a mixture of the non-magnetic developer and magnetic particles while confining the magnetic particles within the container using a magnetic field;

disposing a gate electrode adjacent to and upstream of the magnetic member with respect to a movement direction of the developer carrying member to control the passage of the developer;

substantially uniformly applying the non-magnetic developer onto that section of a surface of the developer carrying member which corresponds to a section of the latent image bearing member to be developed and directly and substantially uniformly preventing the application of the developer onto that section of the surface of the developer carrying member which corresponds to a section of the latent image bearing member not to be developed by operation of the gate electrode; and developing the latent image on the latent image bearing member with the developer carrying member carrying the thus applied developer so as to prevent the developer from being deposited on the latent image bearing member at the non-development section.

2. A method according to claim 1, wherein said applying step and said preventing step occur alternately with movement of the developer carrying member.

3. A method according to claim 1, wherein said applying step and said preventing step occur substantially simultaneously at longitudinally different portions on the developer carrying member.

4. A method according to claim 3, wherein said development section is determined in accordance with the size of a transfer material to which the developed image is transferred.

5. A method according to claim 1, wherein in said developing step, an alternating electric field is formed between the latent image bearing member and the developer carrying member for moving the developer therebetween.

6. A method according to claim 1, wherein in said developing step, an alternating electric field is formed between the latent image bearing member and the developer carrying member for moving the developer therebetween, and wherein the developed image is transferred onto a transfer material.

7. A method according to any one of claims 1 to 6, wherein said applying step is effected by applying to the gate electrode a voltage of a polarity the same as that of the developer, wherein said preventing step is effected by applying to the gate electrode a voltage of a polarity opposite to that of the developer, and wherein the polarity of the applied voltage is controlled in accordance with the boundary between the development section and the non-development section.

8. A method according to claim 7, wherein said magnetic field is formed by providing the magnetic member adjacent the outlet of the developer container and a stationary magnetic field producing means 5–50 degrees upstream of the confining member with respect to the movement direction of the developer carrying member.

9. A method of developing a latent image formed on a latent image bearing member by latent image forming means, comprising the steps of;

providing a first developing carrying member, movable along an enless path, for carrying a first non-magnetic developer for deposit on the latent image bearing member;

disposing a first magnetic member adjacent to a surface of the first developer carrying member so as to allow the first developer to be fed from a first developer container containing a mixture of the first non-magnetic developer and magnetic particles while confining the magnetic particles within the first container using a magnetic field;

disposing a first gate electrode adjacent to and upstream of the first magnetic member with respect to a movement direction of the first developer carrying member to control passage of the first developer;

substantially uniformly applying the first developer onto that section of a surface of the first developer carrying member which corresponds to a first development section of the latent image bearing member to be developed and directly and substantially uniformly preventing the application of the first developer onto that section of the surface of the first developer carrying member which corresponds to a first non-development section of the latent image bearing member not to be developed by operation of the first gate electrode;

developing the latent image on the latent image bearing member with the first developer carrying member carrying the thus applied first developer so as to prevent the first developer from being deposited on the latent image bearing member at the first non-development section;

providing a second developer carrying member, movable along an endless path, for carrying a second non-magnetic developer for deposit on the latent image bearing member;

disposing a second magnetic member adjacent to a surface of the second developer carrying member so as to allow the non-magnetic developer to be fed from a second developer container containing a mixture of the second non-magnetic developer and magnetic particles while confining the magnetic particles within the second container using a magnetic field;

disposing a second gate electrode adjacent to and upstream of the second magnetic member with respect to a movement direction of the second developer carrying member to control passage of the second developer;

substantially uniformly applying the second developer onto that section of a surface of the second developer carrying member which corresponds to a second development section of the latent image bearing member and directly and substantially uniformly preventing the application of the second developer onto that section of the surface of the second developer carrying member which corresponds to a second non-development section of the latent image bearing member not to be developed by operation of the second gate electrode; and developing the latent image on the latent image bearing member with the second developer carrying member carrying the thus applied second developer so as to prevent the second developer from being deposited on the latent image bearing member at the second non-development section.

10. A method according to claim 9, wherein the first development section and the second development section are different, and wherein the first developer and the second developer are different.

11. A method according to claim 9, wherein the first developer and the second developer are different in color, and the sections developed by said two developing steps are simultaneously transferred onto a transfer material.

12. A method according to any one of claims 9 to 11, wherein each applying step is effected by applying to the associated gate electrode a voltage of a polarity the same as that of the developer in the associated container, wherein each preventing step is effected by applying to the gate associated electrode a voltage of a polarity opposite to that of the developer in the associated container, and wherein the polarity of such voltage is controlled in accordance with the boundary between the associated development and non-development sections.

13. A method according to claim 12, wherein each magnetic field is formed by providing the associated magnetic member adjacent the outlet of the associated container and a stationary magnetic field producing means 5–50 degrees upstream of the magnetic member with respect to the movement direction of the associated developer carrying member.

14. An apparatus for developing a latent image formed on a latent image bearing member by latent image forming means, comprising:

a developer carrying member, movable along an endless path, for carrying a non-magnetic developer for deposit on the latent image bearing member;

a developer container for containing the developer;

means for applying the developer onto a surface of the developer carrying member, said applying means including a magnetic member disposed adjacent to a surface of said developer carrying member so as to allow the non-magnetic developer to be fed from a developer container containing a mixture of the non-magnetic developer and magnetic particles while confining the magnetic particles within the container using a magnetic field and a gate electrode disposed adjacent to and upstream of said magnetic member with respect to a movement direction of said developer carrying member to control the passage of the developer;

control means for controlling said gate electrode means to apply substantially uniformly the developer onto that section of the surface of said developer carrying member which corresponds to a section of the latent image bearing member to be developed, but to directly prevent substantially uniform application of the developer onto that section of the surface of said developer carrying member which corresponds to a section of the latent image bearing member not to be developed; and means for effecting development of the latent image on said latent image bearing member with said developer carrying member carrying the thus applied developer.

15. An apparatus according to claim 14, wherein said development section is interposed between the non-development section in the direction of movement of said developer carrying member.

16. An apparatus according to claim 14, wherein the non-development section is adjacent to the development section, in the longitudinal direction of said developer carrying member.

17. An apparatus according to claim 16, wherein said development section corresponds to the size of a transfer material to which the developed image is transferred.

18. An apparatus according to claim 14, wherein said gate electrode includes a plurality of electrodes to which a voltage is supplied, the voltage being selectively the same as or opposite to a polarity of the developer which is electronically charged when mixed with the magnetic particles, and wherein the voltage of the same polarity is applied when the developer is to be applied to the surface, and the opposite polarity is applied when the developer application is to be prevented.

19. An apparatus according to claim 18, wherein said magnetic member is adjacent an outlet of said container, said apparatus further comprising magnetic field generating means disposed across said developer carrying member from said magnetic member and upstream of said magnetic member with respect to the movement direction of said developer carrying member.

20. An apparatus according to claim 14, wherein said developer carrying member, developer container, applying means and developing means form a first developing unit utilizing a first developer, and wherein said apparatus further comprises another developer carrying member, developer container, applying means and developing means forming a second developer units utilizing a second developer.

21. An apparatus according to claim 14, wherein the surface of said developer carrying member is an insulating layer having $10^7$–$10^{12}$ ohm.cm resistance.

* * * * *

UNITED STATES PATENT AND TRADEMARK OFFICE

CERTIFICATE OF CORRECTION

PATENT NO. : 4,766,468

DATED : August 23, 1988

INVENTOR(S) : NAGAO HOSONO, ET AL.

It is certified that error appears in the above-identified patent and that said Letters Patent is hereby corrected as shown below:

COLUMN 1

Line 11, "to," should read --to--.
Line 19, "and" should be deleted.
Line 62, "is" should read --are--.

COLUMN 2

Line 23, "and" should read --an--.

COLUMN 3

Line 4, "preffered" should read --preferred--.
Line 20, "lens array 1" should read --lens array 2--.
Line 32, "fixing device," should read --fixing device 10,--.
Line 34, "discharging rollers." should read --discharging rollers 11.--.

COLUMN 4

Line 10, "and" should read --but--.
Line 19, "above-descrived" should read --above-described--.
Line 27, "particle" should read --particles--.
Line 29, "particle" should read --particles-- and "is" should read --are--.
Line 46, "particle" should read --particles--.

UNITED STATES PATENT AND TRADEMARK OFFICE

CERTIFICATE OF CORRECTION

PATENT NO. : 4,766,468

DATED : August 23, 1988

INVENTOR(S) : NAGAO HOSONO, ET AL.

It is certified that error appears in the above-identified patent and that said Letters Patent is hereby corrected as shown below:

COLUMN 5

Line 40, "member 15" should read --member 16--.
Line 51, "confining member 15" should read --confining member 16--.
Line 54, "confining member 15" should read --confining member 16--.
Line 58, "its" should read --a--.

COLUMN 6

Line 13, "or" should read --on--.
Line 39, "magnetic 15" should read --magnet 15--.
Line 68, "$10^7$ ohm.cm/$10^{12}$ ohm.cm." should read --$10^7$ ohm.cm-$10^{12}$ ohm.cm.--.

COLUMN 7

Line 18, "to to" should read --to--.

COLUMN 8

Line 52, "magnetic blade 10" should read --magnetic blade 16--.
Line 54, "netic blade 10" should read --netic blade 16--.
Line 60, "magnetic blade 10." should read --magnetic blade 16.--.

UNITED STATES PATENT AND TRADEMARK OFFICE

CERTIFICATE OF CORRECTION

PATENT NO. : 4,766,468

DATED : August 23, 1988

INVENTOR(S) : NAGAO HOSONO, ET AL.

It is certified that error appears in the above-identified patent and that said Letters Patent is hereby corrected as shown below:

COLUMN 10

Line 54, "enless" should read --endless--.

COLUMN 11

Line 66, "gate associated" should read --associated gate--.

COLUMN 12

Line 33, "means" should be deleted.

COLUMN 14

Line 4, "second developer units" should read --second development unit--.

Signed and Sealed this

Twenty-sixth Day of December, 1989

*Attest:*

JEFFREY M. SAMUELS

*Attesting Officer*

*Acting Commissioner of Patents and Trademarks*